US008936505B2

(12) United States Patent
Bengtsson

(10) Patent No.: US 8,936,505 B2
(45) Date of Patent: Jan. 20, 2015

(54) DISPENSERS FOR COIN HANDLING APPARATUS

(71) Applicant: Scan Coin AB, Malmo (SE)

(72) Inventor: Kristian Bengtsson, Bjarred (SE)

(73) Assignee: Scan Coin, AB, Malmo (SE)

( * ) Notice: Subject to any disclaimer, the term of this patent is extended or adjusted under 35 U.S.C. 154(b) by 0 days.

(21) Appl. No.: 13/934,783

(22) Filed: Jul. 3, 2013

(65) Prior Publication Data

US 2014/0030973 A1 Jan. 30, 2014

Related U.S. Application Data

(60) Provisional application No. 61/675,944, filed on Jul. 26, 2012.

(30) Foreign Application Priority Data

Jul. 24, 2012 (EP) ..... 12177631

(51) Int. Cl.
*G07D 1/00* (2006.01)
*G07D 3/16* (2006.01)
(Continued)

(52) U.S. Cl.
CPC .. *G07D 1/00* (2013.01); *G07D 3/16* (2013.01); *G07D 9/008* (2013.01); *G07D 9/02* (2013.01); *Y10S 193/01* (2013.01)
USPC ..... 453/18; 193/DIG. 1

(58) Field of Classification Search
CPC ..... G07D 1/00; G07D 3/00; G07D 9/00; G07D 9/008; G07D 11/003; G07D 11/0018; G07D 2201/00
USPC ..... 453/1, 3, 18, 19, 20, 58, 63; 194/215, 194/344, 350; 193/2 A, 2 R, 27, DIG. 1; 232/1 D, 7, 9, 44, 55, 64; 221/2, 93, 94, 221/174
See application file for complete search history.

(56) References Cited

U.S. PATENT DOCUMENTS 4,950,203 A 8/1990 Tomaiko
6,047,807 A 4/2000 Molbak
(Continued)

FOREIGN PATENT DOCUMENTS

CA 1169734 6/1984 ..... 133/14
GB 14210 6/1911
(Continued)

OTHER PUBLICATIONS

European Search Report Dated Oct. 17, 2012, for Application No. 12177627.2.
(Continued)

*Primary Examiner* — Mark Beauchaine
(74) *Attorney, Agent, or Firm* — Womble Carlyle Sandridge & Rice LLP

(57) ABSTRACT

A coin dispensing apparatus has a cabinet serving as an apparatus housing for the apparatus. The apparatus further has a module for receiving, optionally validating and optionally sorting coins of different types and at least one dispenser for coins to be dispensed. The apparatus is adapted to dispense a specific composition of coins from the at least one dispenser to a portable coin receptacle. Each dispenser comprises a spout and is shaped such that a plurality of dispensers can be placed in a pattern allowing the spouts to be placed in a row. An effect of this is that the sorted coins can be dispensed in a row above the row of spouts, thus there is no need for an additional complex channel system for leading the sorted coins into the correct dispenser.

20 Claims, 11 Drawing Sheets

(51) Int. Cl.
*G07D 9/00* (2006.01)
*G07D 9/02* (2006.01)

(56) References Cited

U.S. PATENT DOCUMENTS

| | | | | |
|---|---|---|---|---|
| 7,018,285 | B2 | 3/2006 | Enomoto | |
| 7,455,579 | B2 * | 11/2008 | Takeuchi | 453/18 |
| 7,625,272 | B1 * | 12/2009 | Moreland et al. | 453/3 |
| 2003/0032388 | A1 | 2/2003 | Rasmussen et al. | |
| 2004/0231955 | A1 | 11/2004 | Carter | |
| 2004/0231956 | A1 | 11/2004 | Adams et al. | |
| 2006/0019591 | A1 | 1/2006 | Abe et al. | |
| 2006/0258278 | A1 * | 11/2006 | Chen | 453/57 |
| 2007/0108267 | A1 | 5/2007 | Jonsson et al. | |
| 2007/0287372 | A1 * | 12/2007 | Condie et al. | 453/57 |

FOREIGN PATENT DOCUMENTS

| | | | |
|---|---|---|---|
| GB | 102491 | 7/1917 | |
| JP | 2004-326418 | 11/2004 | G07D 1/00 |
| JP | 2007-280010 | 10/2007 | G07D 9/00 |
| WO | WO 2005/014046 A1 | 11/2005 | G07D 9/00 |
| WO | WO 2007/035420 A2 | 3/2007 | G06F 7/00 |
| WO | WO 2008/024043 A1 | 2/2008 | G07F 9/06 |

OTHER PUBLICATIONS

European Search Report Dated Oct. 17, 2012, for Application No. 12177631.4, (5 pages).

European Search Report Dated Oct. 17, 2012, for Application No. 12177633.0, (5 pages).

* cited by examiner

DISPENSERS FOR COIN HANDLING APPARATUS

CROSS-REFERENCE TO RELATED APPLICATIONS

This application claims the benefit of European Patent Application No. 12177631.4, filed on Jul. 24, 2012; and claims the benefit of U.S. Provisional Patent Application No. 61/675,944, filed Jul. 26, 2012.

INCORPORATION BY REFERENCE

The entire disclosures of European Patent Application No. 12177631.4, filed on Jul. 24, 2012; and U.S. Provisional Patent Application No. 61/675,944, filed Jul. 26, 2012, are incorporated herein by reference as if set forth in their entireties.

TECHNICAL FIELD

The present invention generally relates to cash handling, and more specifically to coin deposit equipment and coin dispensing equipment.

BACKGROUND ART

Retail cash systems (RCS) are used for handling of cash, such as notes (bills), cheques or coupons in a retail establishment. The systems generally comprise a coin deposit apparatus and a coin dispensing apparatus.

The coin deposit apparatus has to discriminate between different types of acceptable coins, such as valid coins in a plurality of denominations in one or more specific currencies. Preferably, it should also be capable of detecting unacceptable cash, such as fake (counterfeit) coins or coins of a foreign currency. In the coin deposit apparatus a coin acceptance module (CAM) handles the discrimination of coins and is also adapted to count the coins to register the deposited amount. One typical user is a cashier emptying a till after a work shift.

The coin dispensing apparatus contains coins of various denominations. It generally dispenses a specified composition or amount of coins based on the input of a user. It also registers the amount of coins dispensed. The coin dispensing apparatus contains several storage receptacles, typically one for each type of denomination to be dispensed, from which coins are dispensed. One typical use case in this context is a cashier filling a till at the beginning of a work shift.

The coin deposit apparatus and the coin dispensing apparatus can be combined into what is called a coin (or cash) recycling system. In order for such a system to work properly the coin acceptance module of the system also includes sorting capabilities, so that different denominations are discriminated and stored separately from each other, while waiting to be dispensed.

The coin recycling system also has a controller keeping track of all transactions occurring in the system. The system can therefore be utilized as the heart of a settlement system for a retail establishment.

WO-05/104046 discloses a cash recycling machine for a retail establishment in accordance with what has been described above. WO-05/104046 describes how a till is placed with its front end supported on a ledge in order to receive multiple denominations in a sorted condition simultaneously. The described system also provides for bagging operations.

WO-2008/024043 relates to a coin deposit and dispensing apparatus having a cabinet serving as an apparatus housing for the apparatus. The apparatus further has a controller and several dispensers for coins to be dispensed. The apparatus is adapted for dispensing a specific composition of coins under control of the controller from the dispensers to a portable coin receptacle. A closable dispense space is arranged within the cabinet, and the closable dispense space has an open state which permits reception of the portable coin receptacle to be filled, and a closed state which permits dispensing of the specific composition of coins from the dispensers into the portable coin receptacle while shielding the closable dispense space from external access during the dispensing.

The apparatus of WO-2008/024043 is large, complex, and advanced being capable of handling large volumes of coins, which renders it suitable for large retail establishments. There is, however, also a need for coin deposit and dispensing apparatus in smaller retail establishments. The demands on such an apparatus are different in such smaller establishments. A small size and a lower price are important. There is therefore a need for a more compact but still efficient coin deposit and dispensing apparatus.

SUMMARY

The present invention generally aims at eliminating or at least reducing the problems discussed above as well as other problems. This is accomplished with an apparatus in accordance with the appended independent claims.

To better address one or more of these and other concerns, in a first aspect of the invention a coin dispensing apparatus is provided that comprises a cabinet serving as an apparatus housing for the apparatus;

a control means for controlling the apparatus a cash processing module adapted to receive a deposited mass of coins, said module optionally including a coin acceptance module for processing said deposited mass of coins; and a plurality of dispensers for coins to be dispensed, the dispensers each comprising a hopper mounted on an ejector/counter, the each of the hoppers having an upper part for receiving pre-sorted coins or coins from the coin acceptance module and a lower part connected the ejector/counter, the plurality of dispensers being arranged in two parallel rows;

wherein, in a deposit operation, the dispensers are adapted to receive the deposited and optionally processed mass of coins for buffering therein; and wherein, in a dispensing operation, the dispensers are adapted to dispense a specific composition of coins, under control of the control means, to a portable coin receptacle at a dispense location, the upper parts having a spout adapted to guide a coin dispensed from above the spout into the upper part, the spout being an integral projecting part from the upper part, wherein the plurality of dispensers being arranged in a pattern such as each spout belonging to an upper part of a dispenser arranged in one of the two parallel rows is in contact with a spout belonging to an upper part of a dispenser arranged in the second of the two parallel rows, such as each spout being placed in a rectilinear pattern.

By arranging the hoppers in such a way as described above, a pattern of hoppers are formed allowing the spouts of the upper parts of the hoppers to be placed in a row. The effect of the present embodiment may be that the sorted coins can be dispensed from the coin acceptance module in a row above the row of spouts. Thus there is no need for an additional complex channel system arranged to lead the sorted coins into the correct hopper. An advantage of the present embodiment may be that the space required for the purpose of moving the sorted coins from the coin sorting device to the correct hopper is reduced. This may result in a coin dispensing apparatus with a smaller footprint. A further advantage may be that the production of the coin recycling system is simplified and more cost efficient.

By the term "control means" should, in the context of present specification, be understood means for connecting the apparatus to an external control unit, such as a personal computer. The control means could, for example, be a set of cable connections or means for enabling wireless connection such as Ethernet or Bluetooth. In that embodiment, the apparatus is remotely controlled from an external means, such as a computer, typically a personal computer.

A cabinet suitable in accordance with the present invention has a reduced size compared to ordinary coin deposit and dispensing apparatus. Typically, the cabinet could be arranged on a table. Moreover, the cabinet is typically a metal construction of a quality ordinary used in relation to this type of machine.

According to an embodiment of the present invention, the plurality of dispensers may be arranged in a zig-zag pattern.

By the term "arranged in a zig-zag pattern" should, in the context of present specification, be understood that an imaginary line drawn between the points of balance of an inlet of each upper part forms a zig-zag pattern. An effect of the present embodiment may be that arranging the dispensers in such a pattern allows the shape of the spout to be such that the capacity of catching the coin dispensed over it is improved. An advantage of the present embodiment may be that the risk of a coin ending up in the wrong dispenser is reduced. A further advantage of arranging the dispensers in a zig-zag pattern may be that the space required by the dispenser is reduced.

According to a further embodiment of the present invention, the rectilinear pattern of upper edges of the spouts forms a coherent unit of spouts with no open space between the spouts in the plane formed by said upper edges. As there is no open space between the spouts of the dispensers when the dispensers are mounted in the apparatus, there is no risk that a coin falling down from the coin acceptance module would fall outside a spout. Furthermore, this arrangement may also save space and render the apparatus more compact. By the term "inlet of the spout" should, in the context of the present specification, be understood the open part of the spout where a coin may fall and be guided further down into the dispenser.

According to a further embodiment of the present invention, an inlet of each upper part of the plurality of dispensers may be symmetrical. The inlet of the upper part is defined as the open portion of the upper part facing the coin acceptance module of the apparatus 100. An advantage of the present embodiment may be that the space required by the dispenser is reduced because the upper parts can be fitted closely together.

According to yet another embodiment of the present invention, each of the spouts has a part that may be rectangular in cross-section. By having a rectangular cross-section, the risk of a coin falling into the wrong spout may be decreased.

According to an embodiment of the present invention, the plurality of dispensers may be 3-10 in number. It may be advantageous to have enough dispensers so that all different denominations of the currency or currencies currently being sorted can be dispensed into different dispensers.

According to a further embodiment of the present invention, the upper part of each of the plurality of dispenser may be detachably attached to the lower part. An effect of the present embodiment may be that the upper part is easily removed from the lower part. An advantage of the present embodiment may be that maintenance of the dispenser is facilitated.

According to yet another embodiment of the present invention, an inlet each upper part of the plurality of dispensers may be have the same size and shape. An advantage of the present embodiment may be that the production of the upper parts of the dispensers is simplified and/or more cost efficient.

According to yet another embodiment of the present invention, at least one of the inlets of the upper parts of the plurality of dispensers may have a different shape. An advantage of the present embodiment may that the size of the dispensers is adapted to the size of the coins being dispensed to it. Further, the size may also be adapted to the number of coins being dispensed into it.

According to yet another embodiment of the present invention, each of the upper parts of the coin dispensing apparatus may be mutually changeable. Thus, when assembling and mounting the dispensers in the coin dispensing apparatus, there may be no need of a thorough check on which upper part should be mounted on which position in the plurality of dispensers for coins to be dispensed. A further advantage may be that if a dispenser is broken for some reason and there is a dispenser currently not being used in the coin dispensing apparatus, a simple switch between the dispensers may be enough for keeping the coin dispensing apparatus running.

According to a further embodiment of the present invention, each dispenser of the plurality of dispensers is slidably mounted in the coin dispensing apparatus. An advantage of the present embodiment may be that maintenance of the dispenser is facilitated. A further advantage may be that the assembling and mounting of the dispensers in the coin dispensing apparatus is facilitated. An effect of the present embodiment may be that the dispensers mounted in the coin dispensing apparatus are easily withdrawable from the apparatus. An advantage of the present embodiment may be that maintenance of the dispenser is facilitated. A further advantage may be that the assembling and mounting of the dispensers in the coin dispensing apparatus is facilitated. This arrangement allows for efficient relief of a situation when a particular dispenser has buffered so many coins (as deposited and sorted by the coin acceptance module) that it approaches a state of overfilling or when, for some other reason, content stored in a dispenser needs to be removed by hand. This in turn reduces the resources needed for maintenance, making the coin dispensing apparatus more economic.

According to a further embodiment of the present invention, each dispenser of the plurality of dispenser may have a handle arranged at the inlet of the upper part. This may simplify the handling of the dispensers.

According to a second aspect of the present invention, a hopper suitable for receiving coins from a coin dispenser and releasing coins to a coin receptacle optionally via a till filling distributor is provided. The hopper having an upper part for receiving coins from the coin acceptance module and a lower part connected the ejector/counter, the upper part having a spout adapted to guide a coin dispensed from above the spout into the upper part, the spout being an integral projecting part from the upper part. The hopper is adapted for being mounted to an apparatus of the first aspect.

In a third aspect, the present invention provides use of a hopper according to the second aspect for guiding a coin from a coin dispenser to a coin receptacle optionally via a till filling distributor in a coin deposit and dispensing apparatus.

The second and third aspect may generally have the same features and advantages as the first aspect.

Other objectives, features and advantages of the present invention will appear from the following detailed disclosure as well as from the drawings.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of the element, device, component, means, step, etc., unless explicitly stated otherwise.

Moreover, the term "coins" is to be interpreted as encompassing monetary coins but also similar value-representing objects such as markers or tokens.

BRIEF DESCRIPTION OF THE DRAWINGS

The above, as well as additional objects, features and advantages of the present invention, will be better understood through the following illustrative and non-limiting detailed description of embodiments of the present invention, with reference to the appended drawings, where the same reference numerals will be used for similar elements, wherein.

DETAILED DESCRIPTION OF EMBODIMENTS OF THE INVENTION

Figure 1:
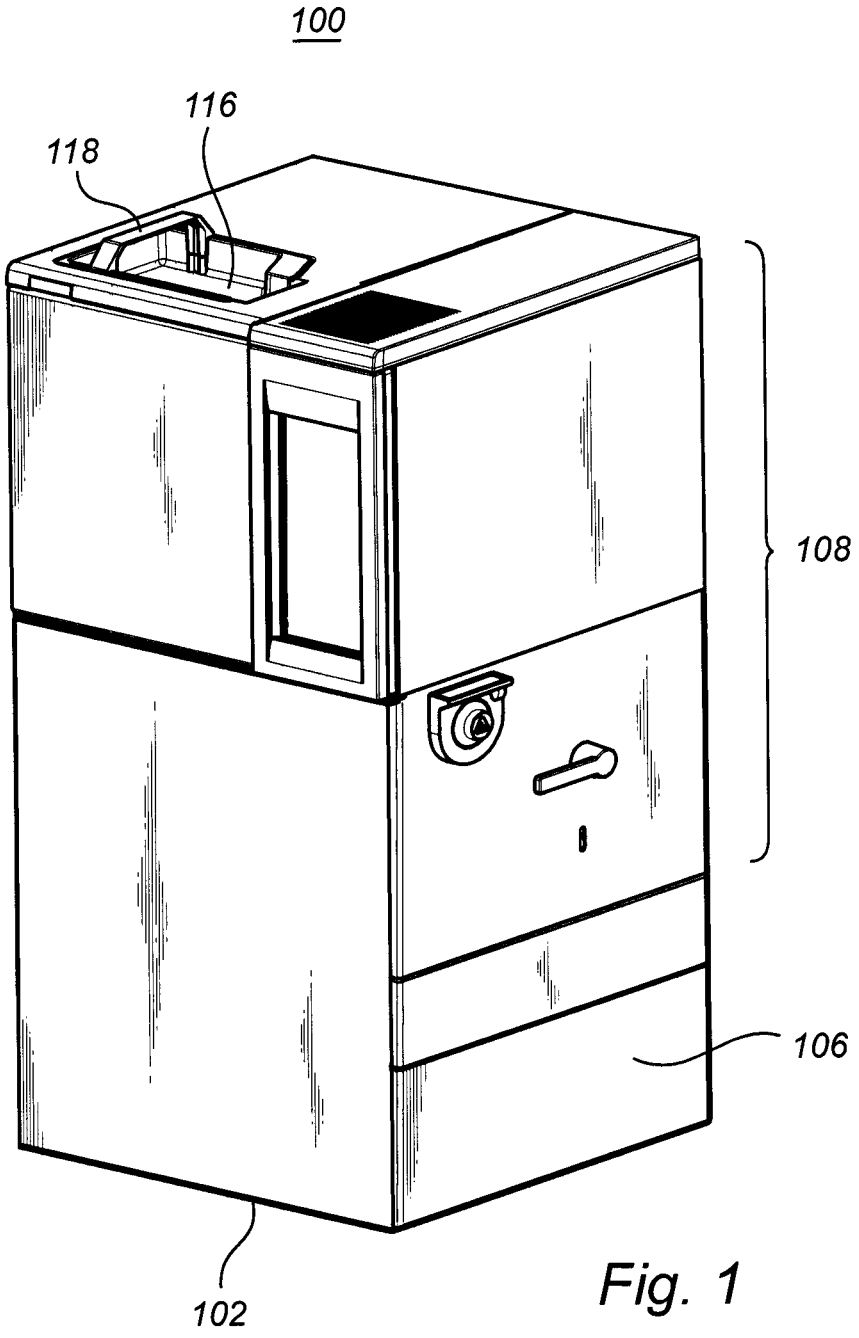
FIGS. 1-3 are perspective front views of a coin deposit and dispensing apparatus according to an embodiment of the present invention.

FIG. 1 illustrates a coin deposit and dispensing apparatus 100 in accordance with a first embodiment of the invention. The apparatus is comprised in a single cabinet 102 and includes several combined modules, each filling one or more specific functions. It is emphasized that the combination of modules, as well as functions within an individual module, described in the following in some detail with reference to the drawings is not the only possible alternative. Modules and functions within individual modules can be added, altered, and excluded without leaving the inventive concept as defined by the appended claims.

The apparatus 100 generally consists of two main modules: a cash storage module 106 at the bottom of the apparatus, and a cash processing module 108 above the cash storage module. These modules 106, 108 are divided into sub modules and will be described in the following.

The purpose of the apparatus 100 is to simplify and render more effective the handling of cash in general and coins in particular. Instead of sending all incoming coins from customers to a remote bank or CIT company and thereafter receiving coins for daily operation from the same bank, etc., the apparatus 100 renders it possible to recirculate coins from customers to the highest possible extent. This reduces costs related to CIT operations and work related to handling and maintenance. Further, the apparatus 100 simplifies the daily handling of coins. The apparatus 100 according to an embodiment of the invention has two main operations: coin deposit (where coins are input by a user and then optionally counted, optionally sorted and buffered) and coin dispensing (where coins buffered in the apparatus are dispensed to a user).

The apparatus 100 has control means (not shown) for controlling the apparatus. Typically means for connecting the apparatus to an external control unit is a set of cable connections or a means for enabling wireless connection. The machine may also be controlled by an internal control unit that optionally is connected to an external network or an external computer. In order to minimize size of the coin deposit and dispensing apparatus, it is preferred that the machine only contains means for connecting it to an external control unit. It is easy for the skilled person to select suitable wire-less or cable-based connection solutions.

Other embodiments may however use one or more local control units in some or all of the modules of the apparatus, such local control units being configured to cooperate as required.

In some embodiments, the control units may serves as a central controller unit for the entire apparatus 100, including the coin processing module 108.

In one embodiment, the user deposits coins into the apparatus by simply fill pre-sorted coins directly into one or more individual coin dispensers 142. This embodiment is not shown in the enclosed figures. Here, the function of the cash processing module is simply to allow the user to deposit the coins into the apparatus 100.

When depositing coins in another embodiment, the user empties, for example, a till into a coin input tray 116. The contents of such a till can be a mixed mass of coins, valid as well as invalid, as well as other foreign material such as paper clips, dust etc. Note that valid coins could include more than one currency (including tokens, jubilee coins, gift coins and such). The end-user may then tilt the tray 116 by lifting it by the handle 118, thereby causing the contents to slide down the bottom surface of the tray 116 and into the interior of the cash processing module 108.

Figure 2:
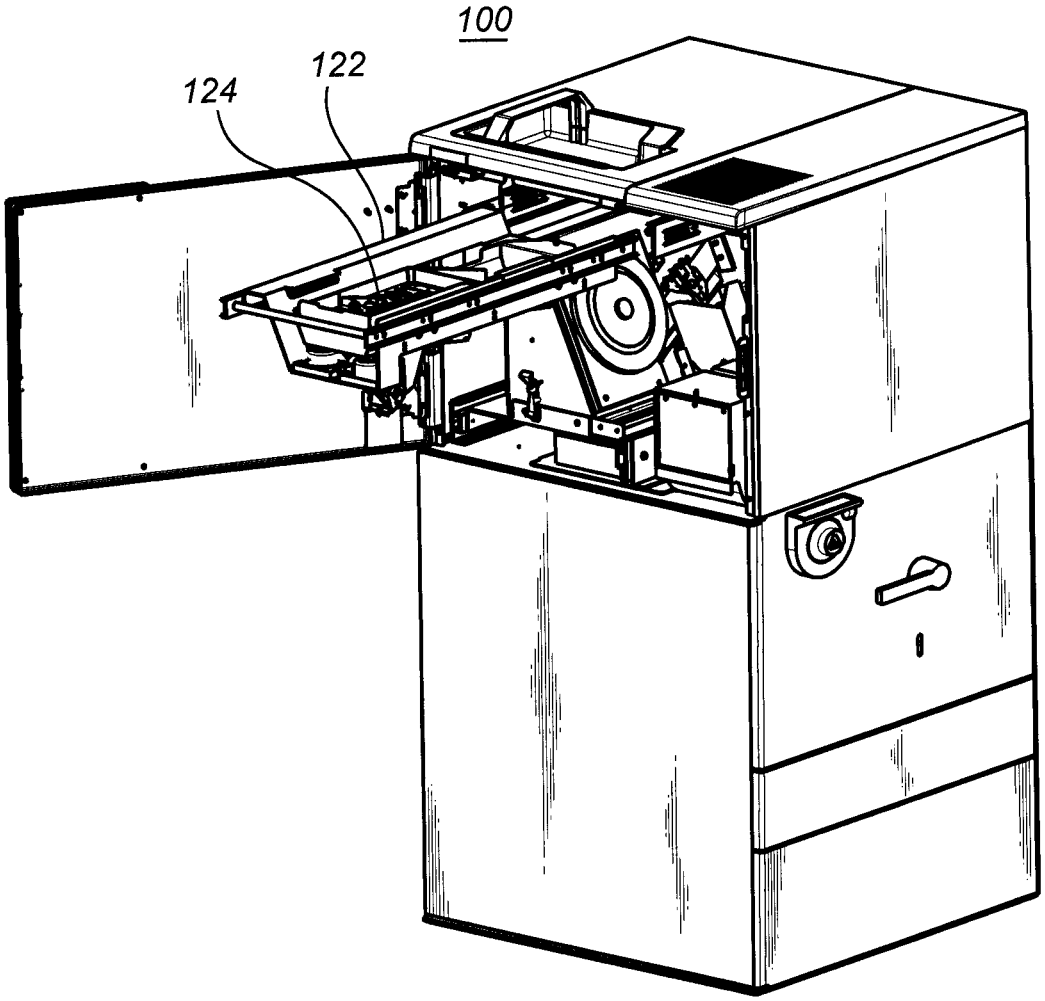

In the cash processing module 108 the contents may first pass an automatic coin conditioning (ACC) unit 122. This unit is shown in greater detail in FIG. 2. Like most of the other sub modules the ACC-unit 122, when present, is slidably arranged on a pair of rails so that it can be retractably pulled out from the interior of the cabinet. In FIG. 2 the ACC-unit 122 is shown in the pulled-out state. The ACC-unit involves a vibratory arrangement of perforated plates 124. This arrangement will separate foreign matter from the mass of coins. When the cash has been conditioned in the ACC it is forwarded to a coin acceptance module (CAM) 126.

Figure 3:
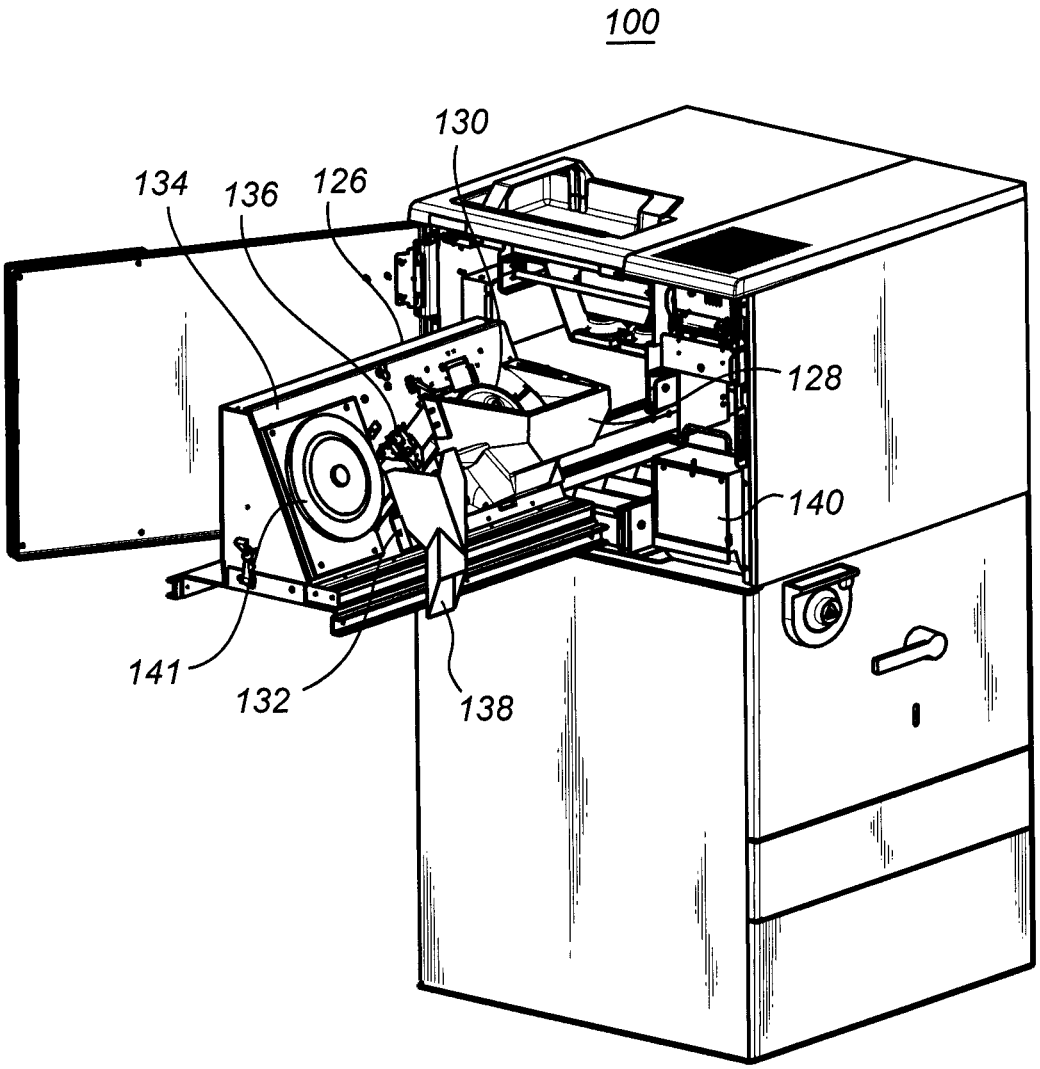

The optional coin acceptance module 126 is shown in greater detail in FIG. 3, in a pulled-out state, similar to the ACC-unit of FIG. 2. One purpose of the CAM 126 is to separate valid coins from invalid ones. The CAM 126 also serves the purpose of determining the type (e.g. denomination) of the valid coins, to count the number of valid coins of each type (denomination), and to sort them, thus enabling full control of transactions occurring thus far in the apparatus 100. The ACC 122 forwards the conditioned coins to a hopper bowl 128 via a receiving tray (not shown). A rotary flexible disc 130 is provided in the hopper bowl 128 and acts to pick up individual coins and bring them to the beginning of a downwardly sloping coin rail 132, mounted to a backwardly inclined front plate 134 of the CAM 126. Each coin will roll, by gravity, down the coin rail 132 and past a coin sensor unit 136.

The coin sensor unit 136, when present, will detect certain physical properties of the passing coin, such as conductivity, permeability, diameter and thickness, and compare these to pre-stored coin reference data in a memory by way of a processor in or coupled to the CAM 126. If the comparison fails to identify the coin as a coin of a valid denomination, it will be regarded as invalid and be deflected through a reject channel 138 to a cash reject area 140.

If on the other hand a valid denomination has been established for the coin, its denomination or associated value will be recorded for later use when calculating a total value for all valid coins processed during the coin deposit transaction upon its completion.

Valid coins roll down the rail 132 and are transported by a rotary carrier disc 141 along a circular sorting path across a series of openings in the front plate 134. The openings are of increasing size, such that coins of the smallest diameter will fall down through the first opening in the transport direction, whereas coins of the second smallest diameter are separated through the next opening, etc. After passing through one of these openings, the coin is guided into a dispenser 142 of a dispenser unit 144 by one of a plurality of channels (not shown). The lower ends of all these channels are arranged on a straight line at regular intervals.

As disclosed herein, the term "coin acceptance module" typically relates to a module for receiving, validating and sorting coins of different types. An example of a suitable such coin acceptance module can be found in the above mentioned WO-2008/024043. However, any such coin acceptance module of reasonable size where the coins are dispensed along a straight line could be used in accordance with the present invention.

Figure 4:
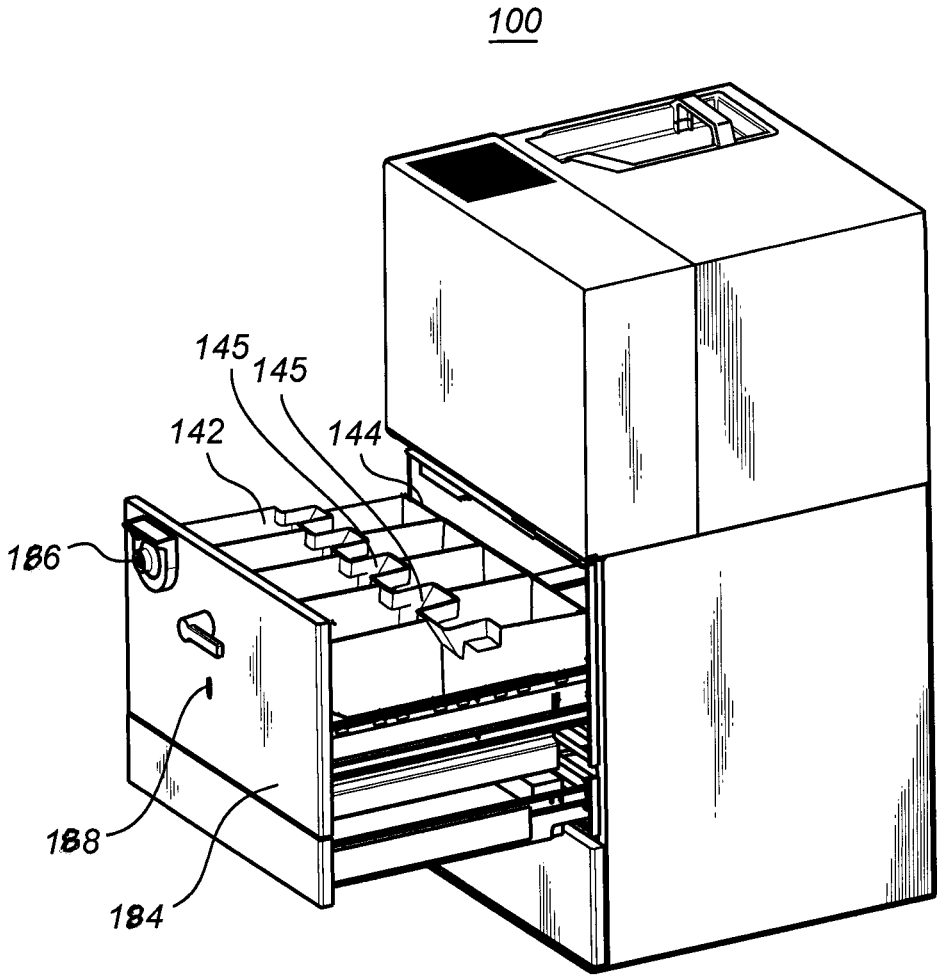
FIG. 4 is a perspective front view of a coin deposit and dispensing apparatus illustrating a plurality of dispensers being arranged in a pattern used in an embodiment of the present invention.

The thus sorted coins will be dispensed along a straight line directly into correct dispensers 142 of a dispenser unit 144, best seen in its pulled-out state in FIG. 4. Each dispenser 142 comprises a spout 145 adapted to guide a coin dispensed from above the spout into the dispenser. By arranging the dispenser in such a way as shown in FIG. 4, the spouts are placed in a row, thereby removing the need of having a complex channel system for guiding the sorted coins into correct dispensers.

In one embodiment, the coin dispenser drawer 184 is opened with a security lock 186 code and a key inserted in a key hole 188. In other embodiments, the locking mechanism is removed. In a further embodiment, the drawer is replaced by a hatch and the dispensers 142 are releasably mounted in a frame means supported by a telescopic rail. In a further embodiment, the dispensers 142 are releasably mounted in a frame means fixed inside the apparatus 100. In yet another embodiment, the dispensers 142 are slidably mounted inside the apparatus. An advantage of mounting the dispenser 142 directly in the apparatus 100 is that this reduces the risk that the apparatus 100 is overturned, which could happen if the dispensers 142 are mounted in frame means supported by the telescopic rail. This reduces the need of fasten the apparatus 100 to the floor with bolts or similar.

In FIG. 4 there are eight dispensers shown. The number of denominations of the Euro currency is eight, so an advantage of this is that all different denominations can be dispensed in different dispensers. The number of dispensers 142 needed may thus depend on the currency the coin dispensing apparatus is adapted for (e.g. three dispensers are needed for the Swedish currency).

Note that valid coins could include more than one currency, e.g. a retail establishment could accept more than one currency (including tokens, jubilee coins, gift coins and such) as payment from its customer. The change given back to a customer, however, usually includes a single currency. This means that the CAM accepts coins that are not to be dispensed at a later stage. These latter coins can be stored in separate dispensers 142 (by denomination/type) or by a single dispenser 142.

Figure 5:
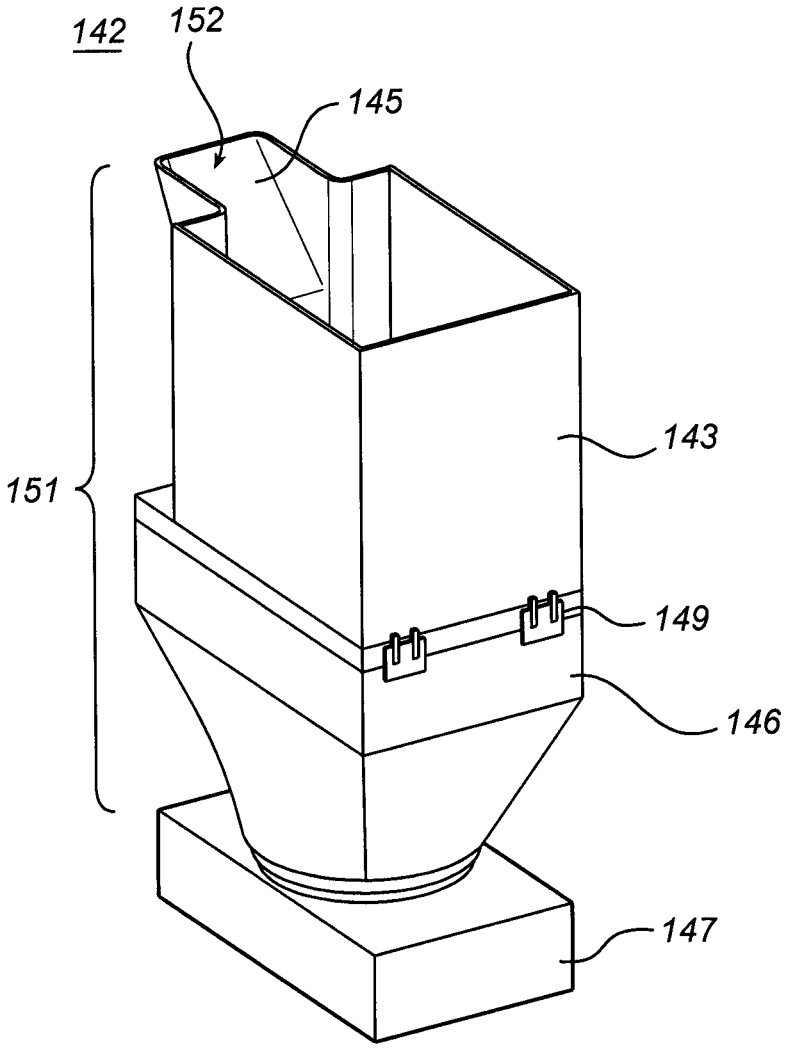
FIG. 5 is a perspective view illustrating a coin dispenser used in an embodiment of the present invention.

As visualised in FIG. 5 an individual dispenser 142 comprises three main parts, an upper part 143 (the visible part of the dispensers 142 in FIG. 4) and a lower part 146 connected the ejector/counter 147. Each dispenser 142 has a buffer capacity associated with a threshold value, usually referring to the number of coins it is allowed to contain. If, during a deposit procedure, the threshold value is reached, the coin ejector 147 associated with the dispenser 142 will typically eject one coin for each coin the dispenser 142 receives. The upper part 143 is detachably attached to the lower part 146 by means of a divisible hinge connection 149. Any other suitable means of attachment may be used.

The upper part comprises a spout 145 integrally projecting from the upper part. According to this embodiment, the shape of the spout is rectangular and it is centrically projecting from the side of the upper part, but alternative shapes and projecting positions is possible. Its shape could, for example, be triangular. The spout could project from the leftmost or rightmost part of the side it is projecting from in FIG. 5. The important thing is that the shape of the dispensers allows a plurality of dispensers to be fitted together and forming a rectilinear pattern of spouts 145. It is also advantageous that the rectilinear pattern of spouts is formed without any open space in between. This may improve the chances that a coin will fall into an inlet 152 of the spout 145 and not fall between the spouts and into the interior of the apparatus 100. The zig-zag pattern of dispensers, according to embodiments of the present invention, is clearly visible in FIG. 4 and FIG. 9.

Figure 6:
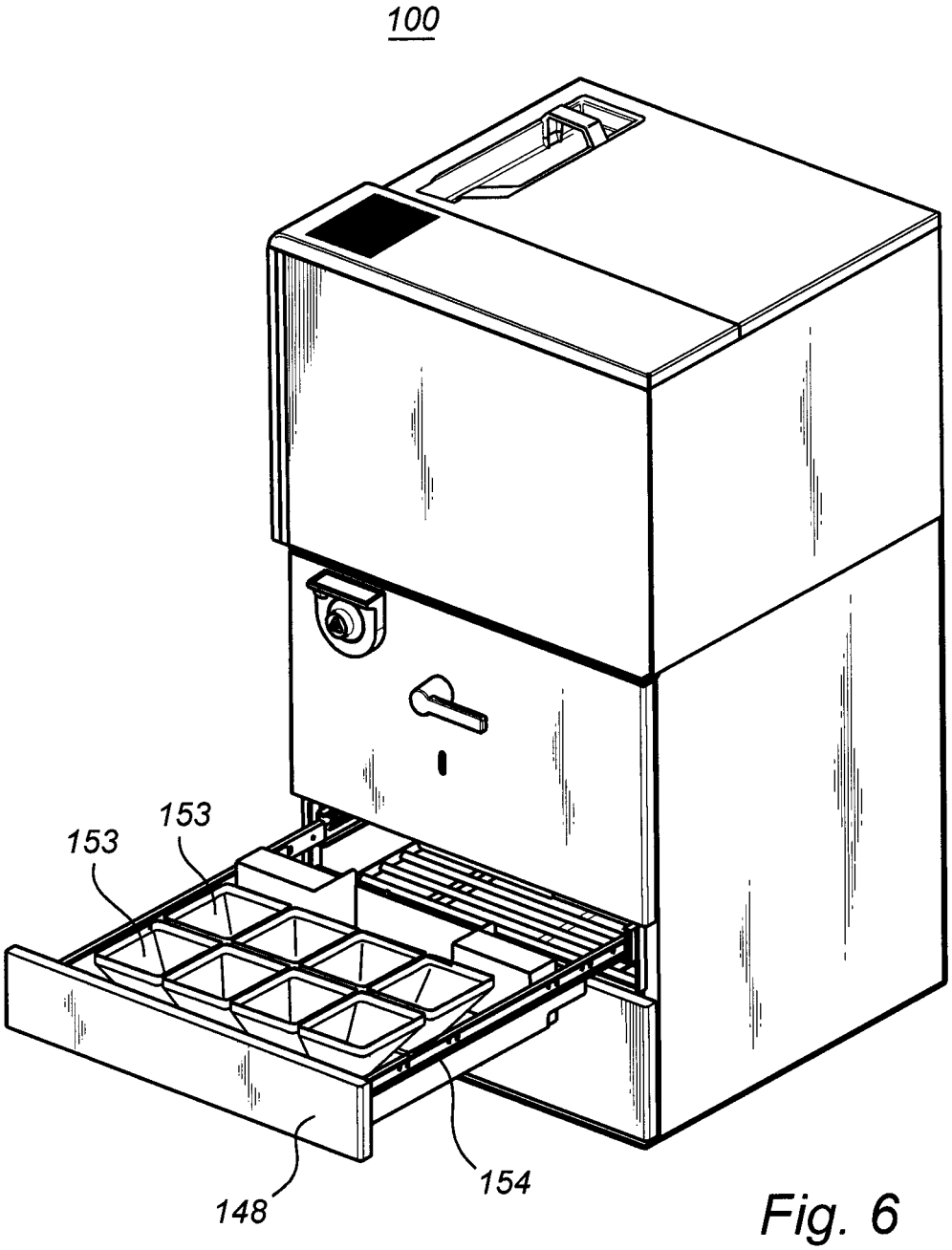
FIG. 6 is a perspective front view of a coin deposit and dispensing apparatus illustrating a plurality hoppers arranged in a pattern according to an embodiment of the present invention.
Figure 7:
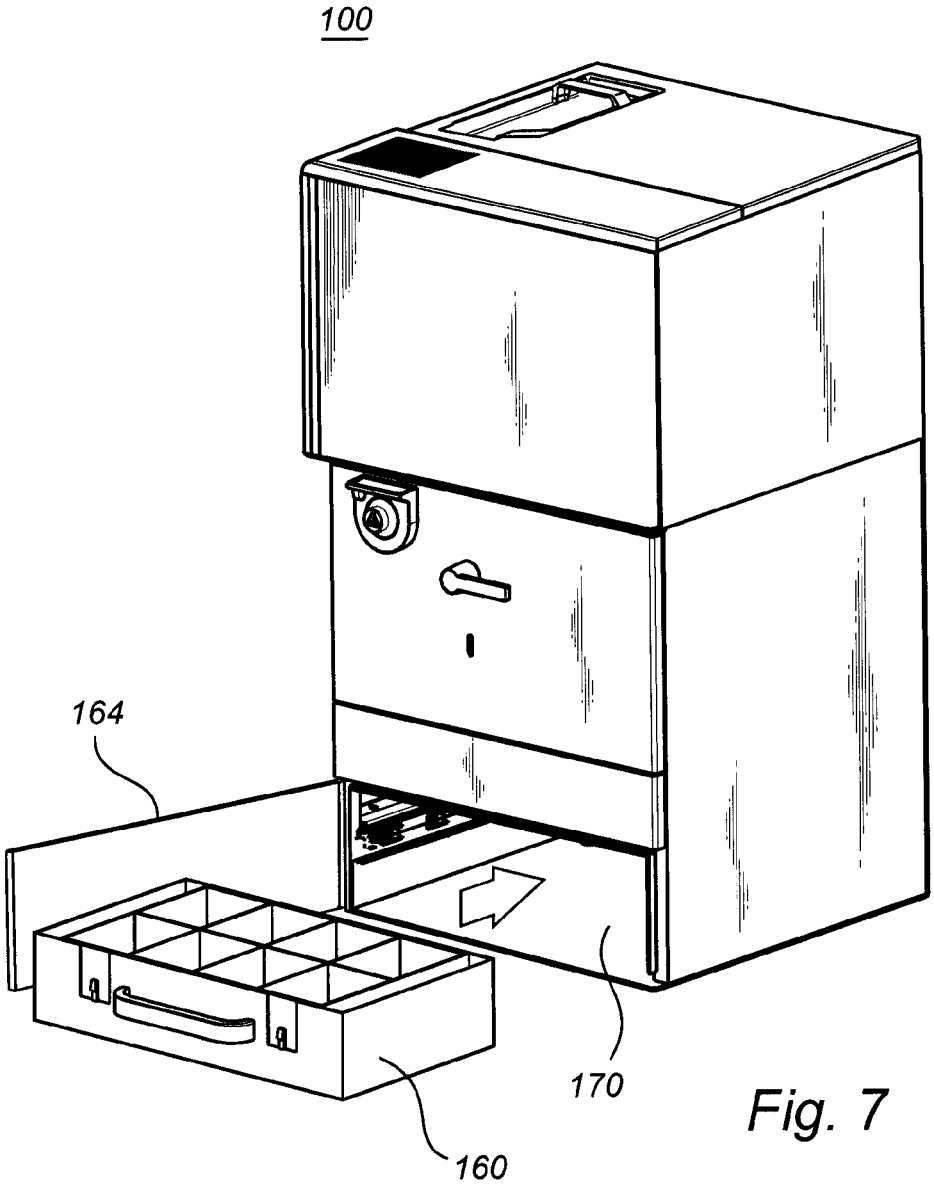
FIGS. 7-8 are perspective front views of a coin deposit and dispensing apparatus illustrating two alternatives of collecting dispensed coins according to embodiments of the present invention
Figure 8:
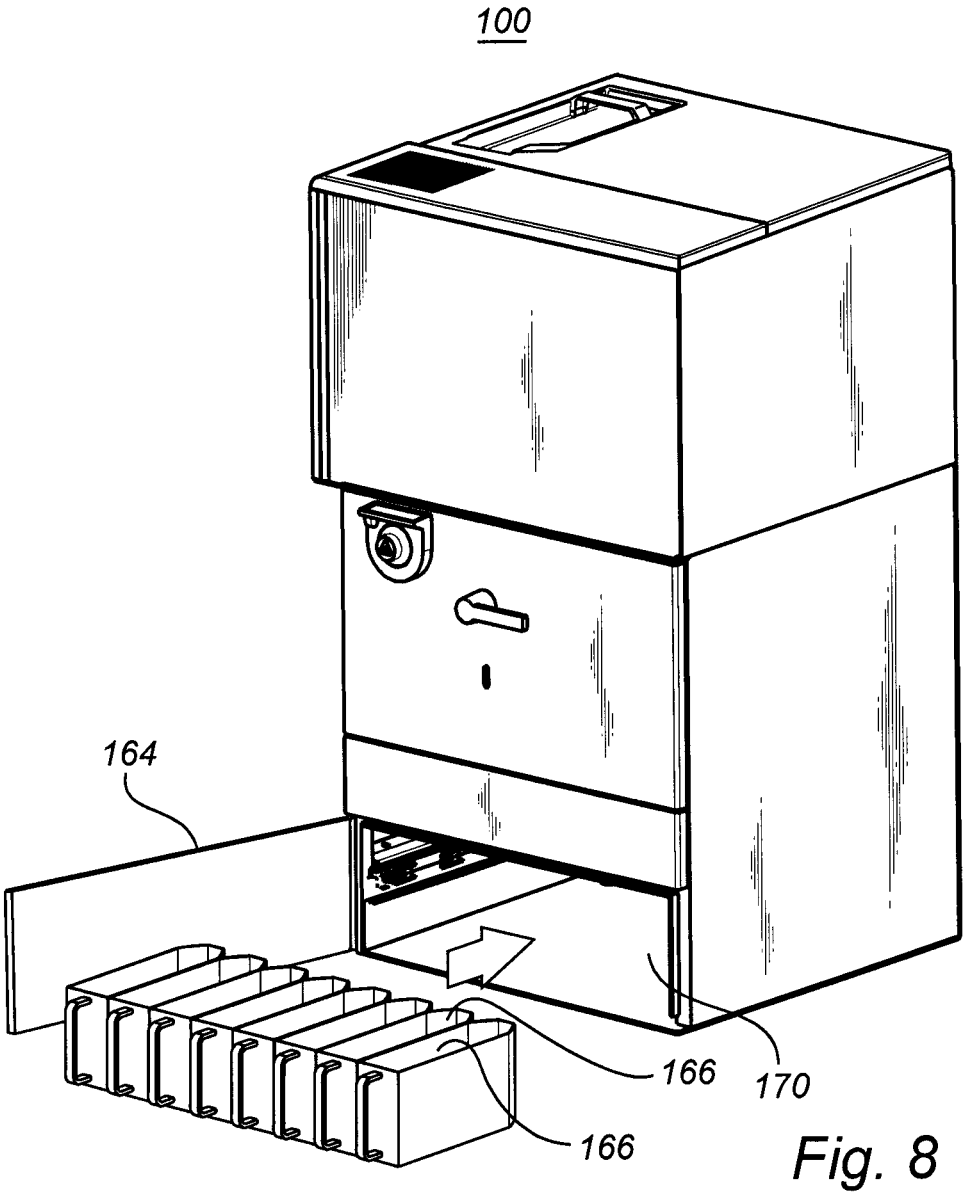
Figure 10:
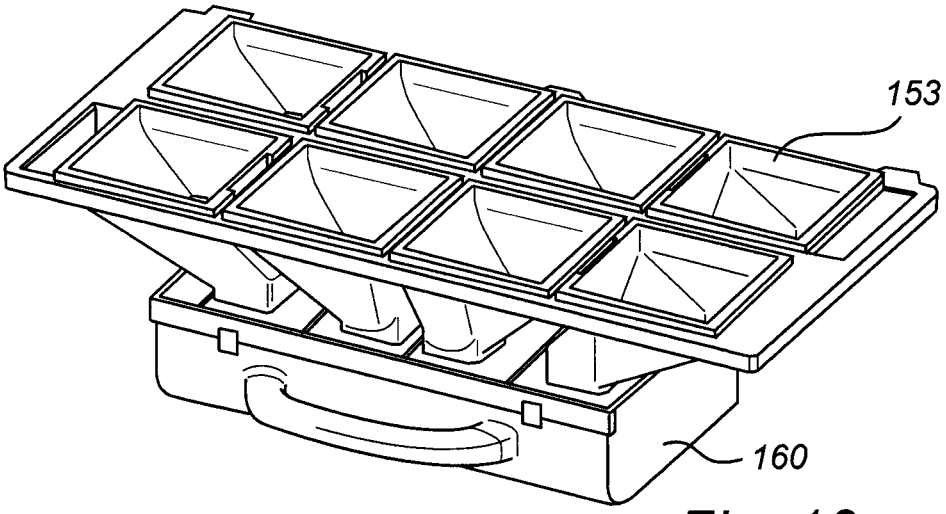
FIGS. 10-11 disclose how releasably mounted till filling distributors could be arranged in order to fit different kinds of portable cash receptacles.
Figure 11:
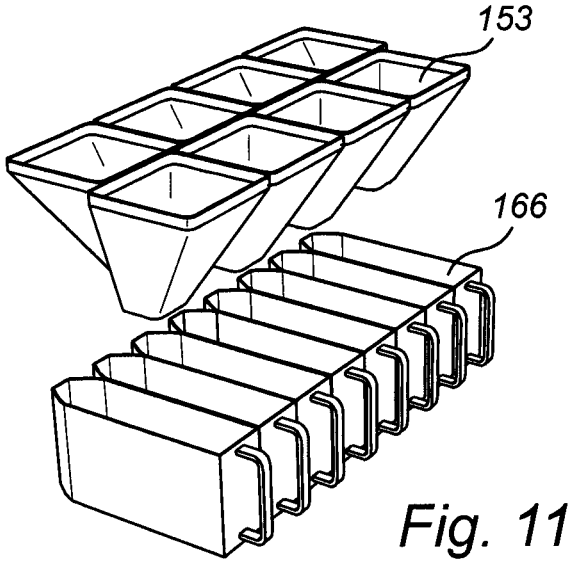
Figure 12A:
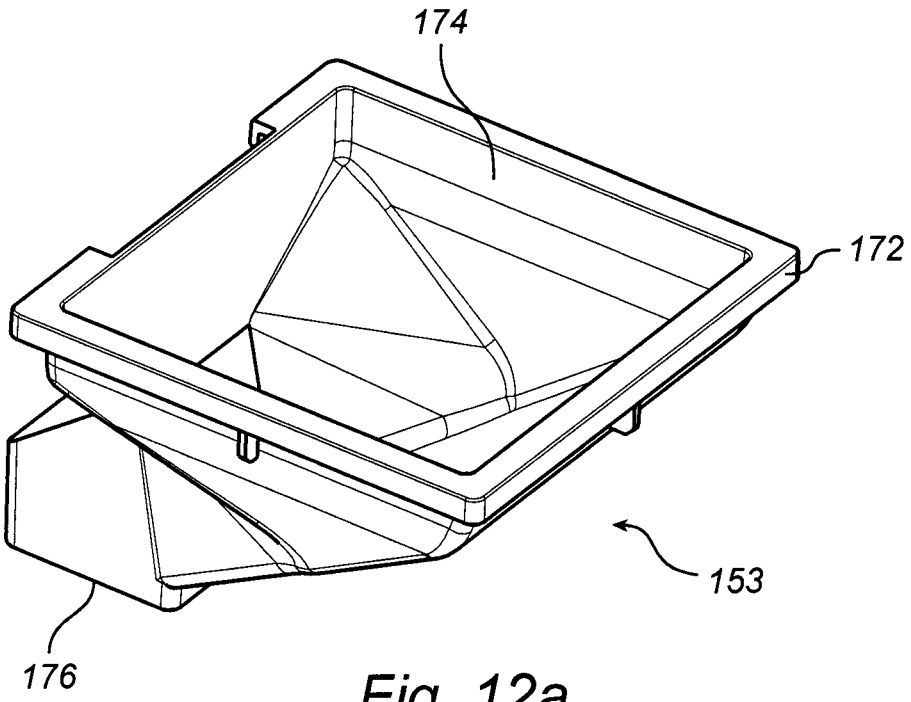
FIG. 12*a*—is a side perspective view of a till filling distributor according to one embodiment, that could be used together with the present invention.
Figure 12B:
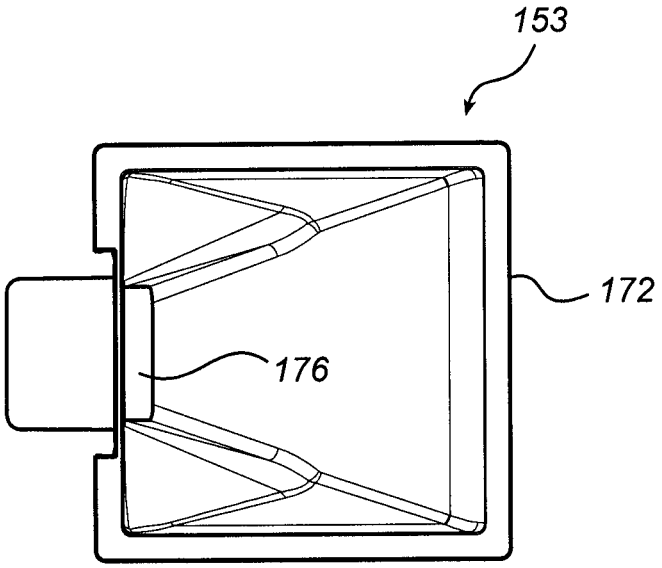
FIG. 12*b*—is a view from above of the till filling distributor of FIG. 12*a;*
Figure 13A:
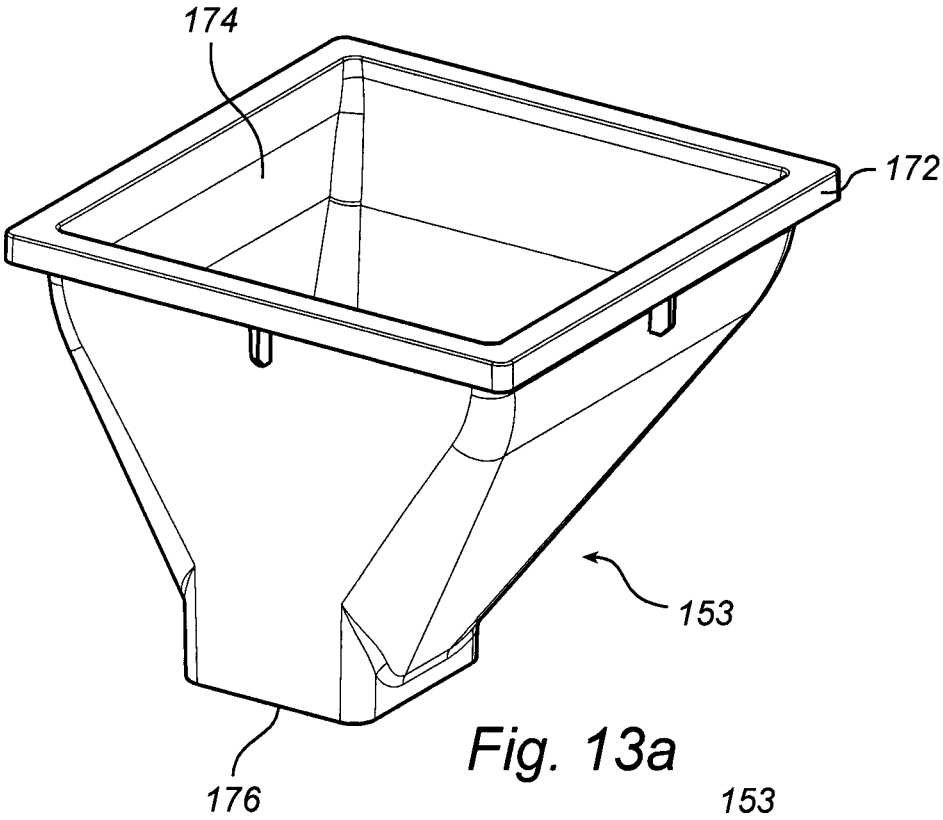
FIG. 13*a*—is a side perspective view of a till filling distributor according to another embodiment, that could be used together with the present invention.
Figure 13B:
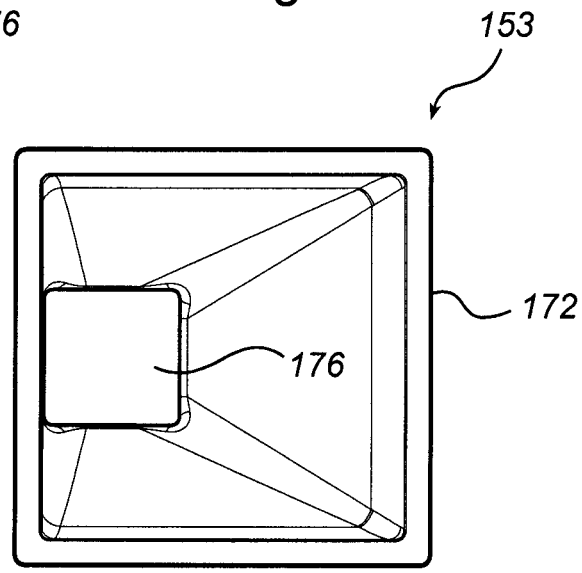
FIG. 13*b*—is a view from above of the till filling distributor of FIG. 13*a*.

As shown in FIG. 6, a plurality of till filling distributors 153 are releasably mounted on a slideable frame 154 behind a drawer 148 by using fastening means. As shown in FIGS. 10 and 11, the till filling distributors 153 are used to guide the coins from the ejector/counter part 147 of a dispenser 142 into a desired compartment of a portable coin receptacle 160, 166. As is evident from the figures, the coins may be guided to another compartment/receptacle by turning/moving a particular till filling distributor 153. The apparatus 100 is generally customized for one type of portable cash receptacle, such as a cash till 160, as seen in FIG. 7, or a set of coin cups 166, as seen in FIG. 8, in that the till filling distributors 153 may be rotated to be adapted for either one of the alternative storage means. The cash till 160 may be a cash till comprising a plurality of compartments, and such a cash till may also have compartments for notes.

In a further embodiment, the drawer is replaced by a hatch. In yet another embodiment the till filling distributors 153 are mounted in a frame means directly beneath the dispensers 142 as seen in FIG. 4.

It is to be noticed that there are no particular limitations as regards the specific composition of coins which is dispensed to the storage means. Generally, any combination of coins of one or more types (such as one or more denominations of coins from one or more currencies) and in one or more amounts is possible. The dispensers are not limited to a particular number, and there in no particular limitations in the relation between the number of dispensers, what type of coins they handle and how such types of coins are received in the portable cash receptacle.

A hatch 164 provides a closable dispensing space and could as such be replaced with a drawer or the like. A security lock code and/or a key inserted in a key hole may be needed for accessing the closable dispensing place. In some embodiments the hatch 164 is removed, leaving an open space for easy access when entering a till 160 or a plurality of coin cups 166. The compact footprint of the apparatus 100 may allow the apparatus to be placed on a table or the like for even easier access to the dispensing location 170 of the apparatus. The bottom of the drawer may also comprise guiding means in order to localise the till 160 or the coin cups 166 at the dispensing location 170.

Figure 9:
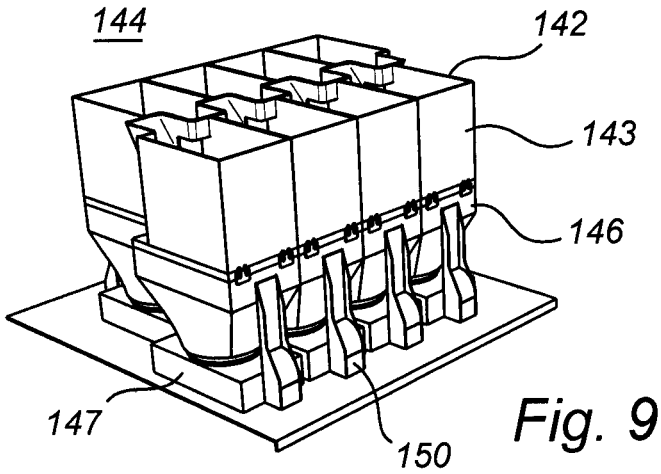
FIG. 9 is a perspective view illustrating a plurality of dispensers being arranged in a pattern used in an embodiment of the present invention.

FIG. 9 shows a dispenser unit 144 comprising eight separate dispensers 142, each are having an upper part 143, a lower part 146 and ejector/counter 147. The dispensers of the dispense module are attached to the apparatus by a releasable fastening means 149 mounted on a frame.

FIGS. 10-11 show alternative configurations of a set of till filling distributors 153. Each of the till filling distributors 153 comprising a wide upper opening for receiving coins from a dispenser 142, via a ejector/counter 147, and a narrow lower opening for releasing coins into a cash till 160 or a set of coin cups 166. The centre of the narrow lower opening is not located directly beneath the centre of the wide upper opening. Consequently, the till filling distributor 153 is adapted to be mounted in a plurality of configurations and positions as shown in FIGS. 10 and 11. A simple rotation of the till filling distributor will lead to a different dispensing position.

Different embodiments of the till filling distributor 153 are shown in a side view and a view from above in FIGS. 12*a*, 13*a* and 12*b*, 13*b*, respectively. The distributor 153 has an upper opening 174 and a lower opening 176. The cross-sections of both the upper opening 174 and the lower opening 176 are square-shaped. There is a protruding edge 172 all around the upper opening 174. This protruding edge supports the distributor 153 when it is hung in a frame together with other such distributors.

The person skilled in the art realizes that the present invention by no means is limited to the embodiments described above. On the contrary, many modifications and variations are possible within the scope of the appended claims. For example, the coin input tray 116 and the handle 118 in FIG. 1 could be replaced by a hatch covering an opening into the interior of the cash processing module 108.

To summarize, herein is presented a coin dispensing apparatus 100 that has a cabinet 102 serving as an apparatus housing for the apparatus 100. The apparatus further has a module for receiving, validating and sorting coins of different types and at least one dispenser 142 for coins to be dispensed. The apparatus is adapted to dispense a specific composition of coins from the at least one dispenser 142 to a portable coin receptacle. Each dispenser comprises a spout 145 and is shaped such that a plurality of dispensers can be placed in a pattern allowing the spouts to be placed in a row. An effect of this is that the sorted coins can be dispensed in a row above the row of spouts, thus there is no need for an additional complex channel system for leading the sorted coins into the correct dispenser.

The invention claimed is:

1. A coin dispensing apparatus comprising:

a cabinet serving as an apparatus housing for the apparatus;

a controller;

a cash processing module adapted to receive a deposited mass of coins; and a plurality of dispensers for coins to be dispensed, the dispensers each comprising a hopper mounted on an ejector/counter, each of the hoppers having an upper part for receiving coins and a lower part in communication with the ejector/counter, the plurality of dispensers being arranged in two parallel rows;

wherein, in a deposit operation, the dispensers are adapted to receive the deposited mass of coins for buffering therein; and wherein, in a dispensing operation, the dispensers are adapted to dispense a specific composition of coins, under control of the controller, to a portable coin receptacle at a dispense location, characterized in that the upper part has a spout adapted to guide a coin dispensed from above the spout into the upper part, the spout is an integral projecting part from the upper part, the plurality of dispensers are arranged in a pattern such as each spout belonging to an upper part of a dispenser arranged in one of the two parallel rows is in contact with a spout belonging to an upper part of a dispenser arranged in the second of the two parallel rows, such as each spout being placed in a rectilinear pattern in relation to each other.

2. A coin dispensing apparatus according to claim 1 wherein the plurality of dispensers is arranged in a zig-zag pattern.

3. A coin dispensing apparatus according to claim 1 wherein the rectilinear pattern of upper edges of spouts forms a coherent unit of spouts with no open space between the spouts in the plane formed by said upper edges.

4. A coin dispensing apparatus according to claim 1 wherein the inlet of each upper part of the plurality of dispensers is symmetrical.

5. A coin dispensing apparatus according to claim 1 wherein each of the spouts has a part being rectangular in cross-section.

6. A coin dispensing apparatus according to claim 1 wherein the amount of dispensers is 3-10.

7. A coin dispensing apparatus according to claim 1 wherein the upper part of each of the plurality of dispensers is detachably attached to the lower part.

8. A coin dispensing apparatus according to claim 1 wherein the inlet of each upper part of the plurality of dispensers has the same shape and size.

9. A coin dispensing apparatus according to claim 1 wherein at least one of the inlets of each upper part of the plurality of dispensers has a different shape.

10. A coin dispensing apparatus according to claim 1 wherein each of the upper parts is mutually changeable.

11. A coin dispensing apparatus according to claim 1 wherein each dispenser of the plurality of dispensers is slidably mounted in the coin dispensing apparatus.

12. A coin dispensing apparatus according to claim 1 wherein each dispenser of the plurality of dispensers has a handle arranged at the inlet of the upper part.

13. The coin dispensing apparatus of claim 1, wherein the cash processing module includes a coin acceptance module for processing said deposited mass of coins.

14. The coin dispensing apparatus of claim 13, wherein, in the deposit operation, the dispensers are adapted to receive from the cash processing module a mass of coins for buffering therein.

15. The coin dispensing apparatus of claim 1, wherein the coins received by the upper part of at least one of the hoppers are pre-sorted.

16. A system including a hopper suitable for receiving coins from a coin dispenser and releasing coins to a coin receptacle, the hopper having an upper part for receiving coins from a coin acceptance module and a lower part in communication with an ejector/counter; wherein, the upper part has a spout adapted to guide a coin dispensed from above the spout into the upper part, the spout is an integral projecting part from the upper part, the hopper is adapted to be received by a dispenser of a coin dispensing apparatus, the dispenser is one dispenser of a plurality of dispensers, the plurality of dispensers being arranged in two parallel rows, and the plurality of dispensers is arranged in a pattern such that each spout belonging to an upper part of a hopper arranged in one of the two parallel rows is in contact with a spout belonging to an upper part of a hopper arranged in the second of the two parallel rows, such that each spout is placed in a rectilinear pattern in relation to each other.

17. The system of claim 16, wherein the coin dispensing apparatus comprises;

a cabinet serving as an apparatus housing for the apparatus;

a controller; and a cash processing module adapted to receive a deposited mass of coins;

wherein, in a deposit operation, the dispensers are adapted to receive the deposited mass of coins for buffering therein; and wherein, in a dispensing operation, the dispensers are adapted to dispense a specific composition of coins, under control of the controller, to a portable coin receptacle at a dispense location.

18. The system of claim 16, wherein the hopper is suitable for releasing coins to the coin receptacle via a till filling distributor.

19. The system of claim 16, wherein, for each spout, an area is defined between the two parallel rows and each spout fills exactly half of the area and fits closely together with neighboring spouts.

20. The system of claim 16, wherein the pattern of dispensers is such that there is no open space in between adjacent spouts of the plurality of dispensers.

* * * * *